US005340209A

United States Patent [19]

Kolbe et al.

[11] Patent Number: 5,340,209

[45] Date of Patent: Aug. 23, 1994

[54] SLIDE-OUT SHELF ASSEMBLY FOR REFRIGERATORS

[75] Inventors: Kenneth W. Kolbe, Ellettsville, Ind.; Scott A. Calvert, Louisville, Ky.

[73] Assignee: General Electric Company, Louisville, Ky.

[21] Appl. No.: 997,578

[22] Filed: Dec. 28, 1992

[51] Int. Cl.[5] ..... A47B 71/00

[52] U.S. Cl. ..... 312/408; 312/404; 312/334.46

[58] Field of Search ..... 312/408, 404, 334.46, 312/334.44, 330.1

[56] References Cited

U.S. PATENT DOCUMENTS

| | | | |
|---|---|---|---|
| 461,375 | 10/1891 | Spaunhorst | 312/330.1 |
| 1,873,933 | 8/1932 | Hunter | 312/330.1 |
| 2,277,702 | 3/1942 | Kennedy | 312/334.46 X |
| 2,755,157 | 7/1956 | Carbary | 312/408 |
| 3,220,364 | 11/1965 | Sandin | 108/144 |
| 3,923,347 | 12/1975 | Dean | 312/334.46 X |
| 4,616,892 | 10/1986 | Schleicher | 312/330.1 |
| 4,735,470 | 4/1988 | Falk | 312/246 |
| 4,934,541 | 6/1990 | Bussan et al. | 211/153 |
| 5,226,707 | 7/1993 | Han et al. | 312/408 |

*Primary Examiner*—Kenneth J. Dorner
*Assistant Examiner*—David E. Allred
*Attorney, Agent, or Firm*—H. Neil Houser

[57] ABSTRACT

A slide-out shelf assembly for a refrigerator includes a pair of supports mounted in spaced apart relationship in a refrigerated compartment. Each support includes a top wall and a pair of spaced apart, depending side walls. The lateral edge portions of a shelf structure are mounted for sliding movement on the support top walls between a retracted position fully contained in the refrigerated compartment and an extended position at least partly out of the refrigerated compartment. A latch member is mounted between the side walls of one of the supports and includes a resilient finger having a rest position in which a portion of the finger projects through an opening in one of the support side walls. The corresponding lateral edge portion of the shelf structure interfits with the projecting portion of the latch to releasably retain the shelf in its retracted and its extended positions and to prevent the shelf structure from being moved out of the refrigerator further than its extended position.

17 Claims, 3 Drawing Sheets

25
22
26
23
36
67
51
52
66
68
34
33
40
9
37
38
30
41
47
39
28
55
29

SLIDE-OUT SHELF ASSEMBLY FOR REFRIGERATORS

BACKGROUND OF THE INVENTION

Modern refrigerators include drawers and shelves which are adjustable within the refrigerated compartment, in that they may be positioned in various vertical locations within the compartment. Also a desire has grown for at least some of the shelves be extendible, that is, for the user to be able to pull such shelves partly out of the compartment for ease of loading and unloading items to be stored. Such movable shelves present a number of problems. It is desirable that the shelf be easily moved. At the same time it is desirable that the shelf not be prone to accidental moving. For example, a refrigerator typically is mounted so as to tilt slightly toward the back. Among other things, this biases the refrigerator doors to close if they are left partially open. It is desirable that a shelf not move "on its own" as a result of such tilting of the refrigerator.

It is an object of the present invention to provide an improved shelf assembly for use in a refrigerator compartment.

It is another object of this invention to provide such an assembly which is easy to operate and, at the same time, stable in its retracted and extended positions.

It is yet another object of this invention to provide such an assembly which is economical to manufacture and sure in operation.

SUMMARY OF THE INVENTION

In accordance with one form of the present invention there is provided an improved slide-out shelf assembly for a refrigerator compartment, including a pair of supports mounted in the compartment in spaced apart relationship. Each of the supports includes a generally horizontal top wall and a pair of spaced apart, depending side walls forming an inverted-U shaped cavity. A shelf structure includes a shelf plate having opposed lateral edges and a molded rim encapsulating the edge of the plate. The rim includes spaced apart side portions with generally horizontal runners resting on the top walls of the supports and depending flanges projecting downwardly adjacent the inside of the inner side walls of the supports so that the shelf structure is mounted to slide on the supports between a retracted position fully within the compartment and an extended position at least partially out of the compartment. An unitary latch member is mounted within the inverted-U shaped cavity of one of the supports and includes a resilient finger. The finger has a rest position or configuration in which a portion of the finger projects through an opening in the inner side wall of the support. The corresponding depending shelf flange includes a slot which registers with the projecting finger portion when the shelf is in its extended position for releasably positioning the shelf.

In the illustrative embodiment the projecting finger portion is formed with a first section facing the rear of the refrigerated compartment and extending transverse to the rear edge of the slot in the flange to prevent the shelf from being moved forward of its extended position. The projecting portion of the finger also includes a smoothly curved portion facing the front of the compartment to limit the effort required to move the shelf from its extended position toward its retracted position.

The shelf flange also includes a recess projecting away from the support side wall and positioned to releasably receive the projecting finger portion when the shelf structure is in its retracted position.

In the illustrative embodiment of the invention, the latch is in the form of an unitary plastic member having a body with a top wall and spaced apart depending side walls. The body is positioned within the inverted-U cavity of the one support with its top and side walls in register with the top and side walls respectively of the support. Tabs project laterally outward of each side of the latch body and are received in mating slots in the support walls to affirmatively position the latch within the support. One of the tabs includes a transverse rib which overlaps the edge of the mating slot. The finger extends from the body of the latch with the projecting portion of the finger extending through an opening in the inner side wall of the support. A resilient tab extends from the opposite end of the body and has a rest position projecting above the top of the latch body. When the latch is mounted in the inverted-U cavity, the resilient tab engages the top wall of the support and urges the finger upwardly within the cavity.

DETAILED DESCRIPTION OF PREFERRED EMBODIMENT

Figure 1:
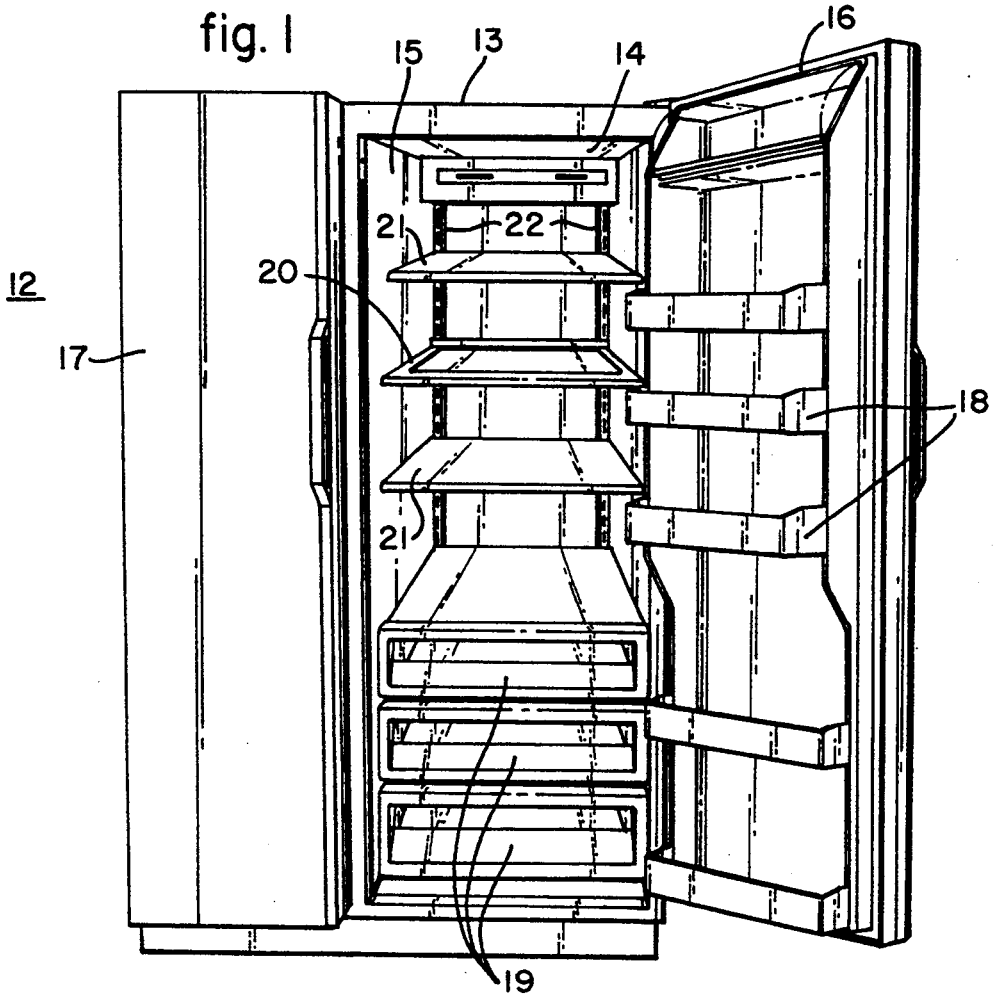
FIG. 1 is a front perspective view of a refrigerator/-freezer type refrigerator, with the refrigerator compartment door open to illustrate various internal components.

Referring now to the drawings, and particularly to FIG. 1, there is illustrated a side-by-side refrigerator/-freezer type of refrigerator 12 having an outer cabinet 13 containing a refrigerated fresh food compartment 14 and a freezer compartment, not shown, separated by an internal wall 15. Access to the fresh food compartment and to the freezer compartment is provided by a fresh food door 16 and a freezer door 17 respectively. Conveniently the door 16 includes a number of shelves 18. Conventionally a number of storage drawers 19 are provided in the lower portion of compartment 14 while vertically adjustable shelves, such as 20 and 21 are provided in the upper portion of the compartment 14. The shelf 20 is a slide-out shelf assembly which the user may pull partially out of the compartment 14 to load or unload items from it and then return it to its retracted position fully within the compartment.

Figure 2:
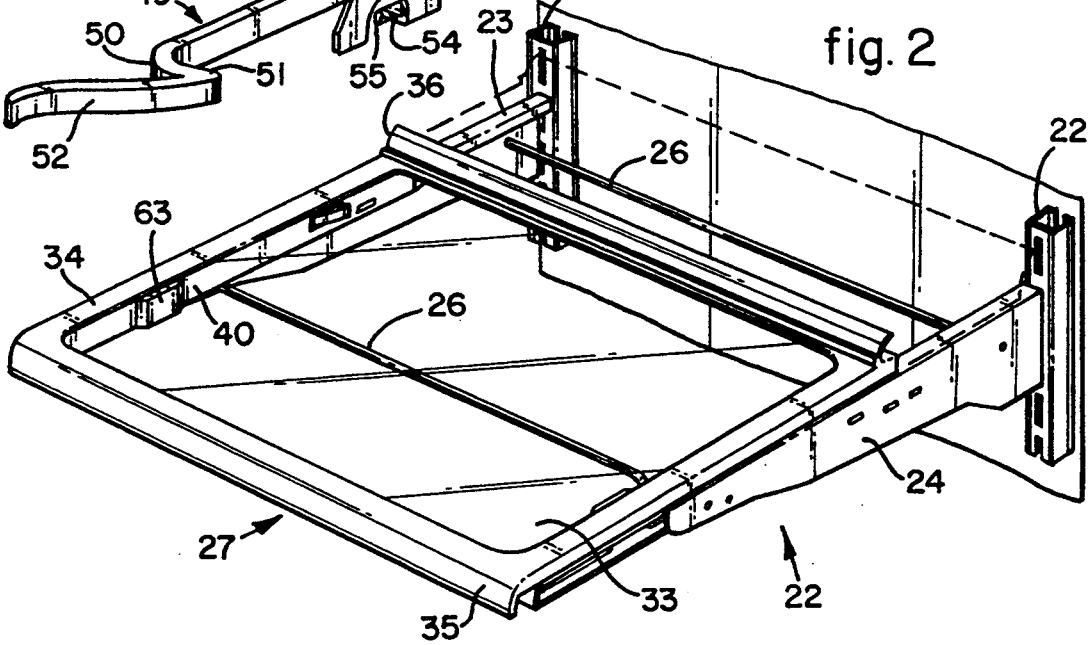
FIG. 2 is a perspective view of a slide-out shelf assembly shown in FIG. 1, with the shelf structure shown in its extended position.
Figures 7, 8, 9:
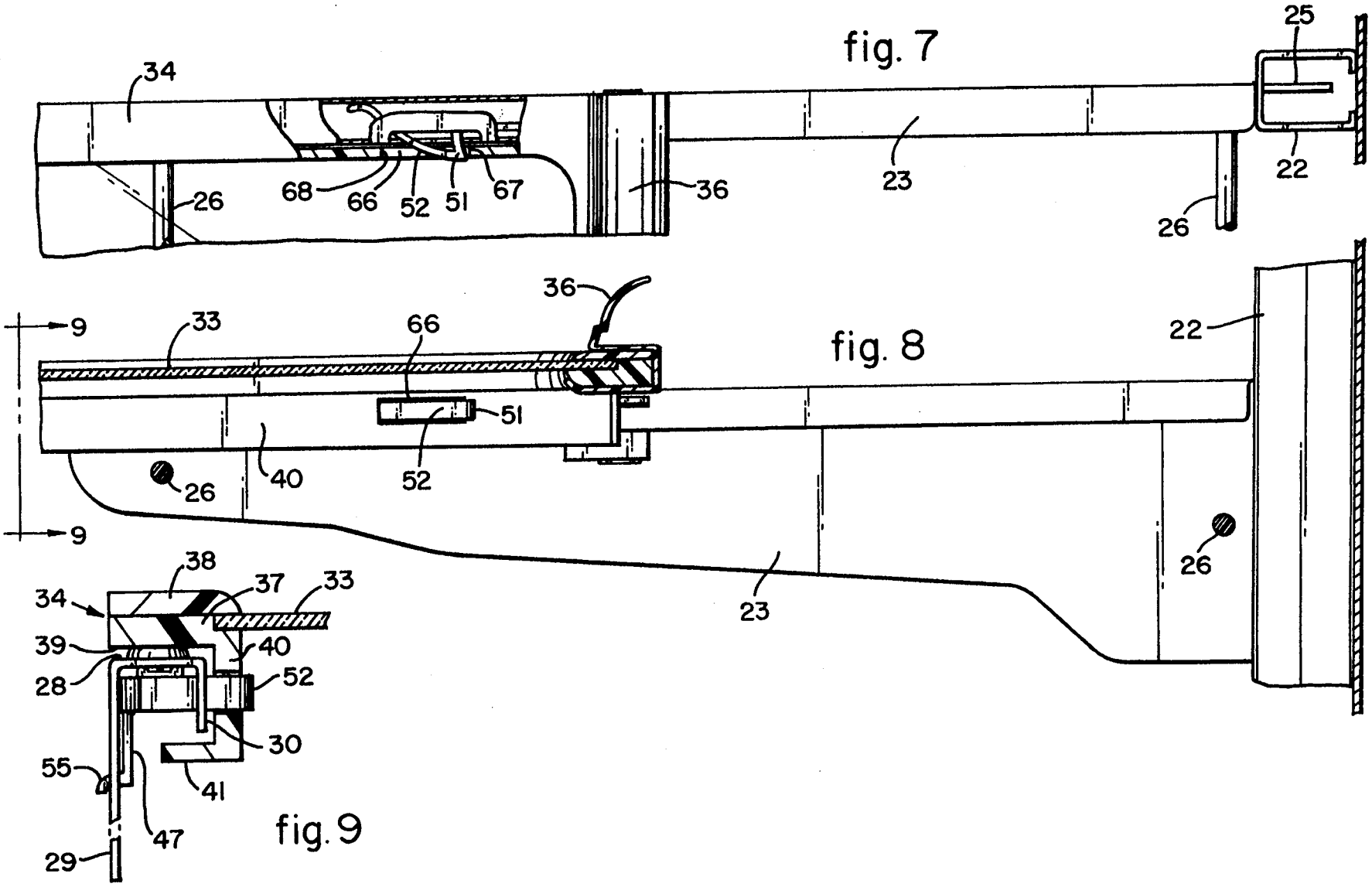
FIG. 7 is a fragmentary plan view similar to FIG. 3, but with the shelf structure in its extended position.
FIG. 8 side elevational view similar to FIG. 4, but showing the shelf structure in its extended position.
FIG. 9 is a cross-sectional view as taken along line 9—9 in FIG. 8.

Referring now particularly to FIG. 2, a pair of ladder tracks or rails 22 are attached to the rear wall of the compartment 14 and provide a base for selectively mounting the various drawers and shelf structures in the compartment at different selected heights. The shelf assembly 20 includes a pair of supports 23, 24 which are mounted to the rails 22 by hooks 25 (See FIG. 3) and are maintained in a predetermined spaced apart relationship by cross bars or rods 26. A shelf structure 27 is mounted on the supports 23, 24 for sliding movement between an extended position, as shown in FIGS. 2, 7 and 8 and a retracted position, as shown in FIGS. 1, 3 and 4.

Turning now particularly to FIGS. 2–8 inclusive, it will be seen that the support 23 includes an elongated, generally horizontal top wall 28 which extends from the vicinity of the rail 22 to close to the front of the compartment 14. An outer side wall 29 depends or extends downwardly from the outer edge of top wall 28 along at least most of its length. Similarly a more narrow inner side wall 30 depends from the inner edge of top wall 28. Top wall 28, together with the spaced apart side walls 29 and 30, define a downwardly open space or cavity 31 having a cross-section shape like an inverted-U.

The preferred embodiment of the shelf structure 27 includes a rectilinear shelf plate 33 comprised of glass or other transparent material such as, for example only, a polycarbonate resin. The lateral edges of the plate 33 are encapsulated by a rim 34, preferably molded from a suitable plastic material such as, for example only, poly (acrylonitrile-butadiene-styrene) (ABS). The front of the rim is turned down to form a handle 35 by which a user can move the shelf between its retracted and extended positions. A guard 36 is positioned across the rear of the rim 34 and conveniently may be a separate member which is clipped on to the rim, as illustrated. Alternatively the guard 36 may be molded as part of the rim.

Figures 3, 4, 5, 6:
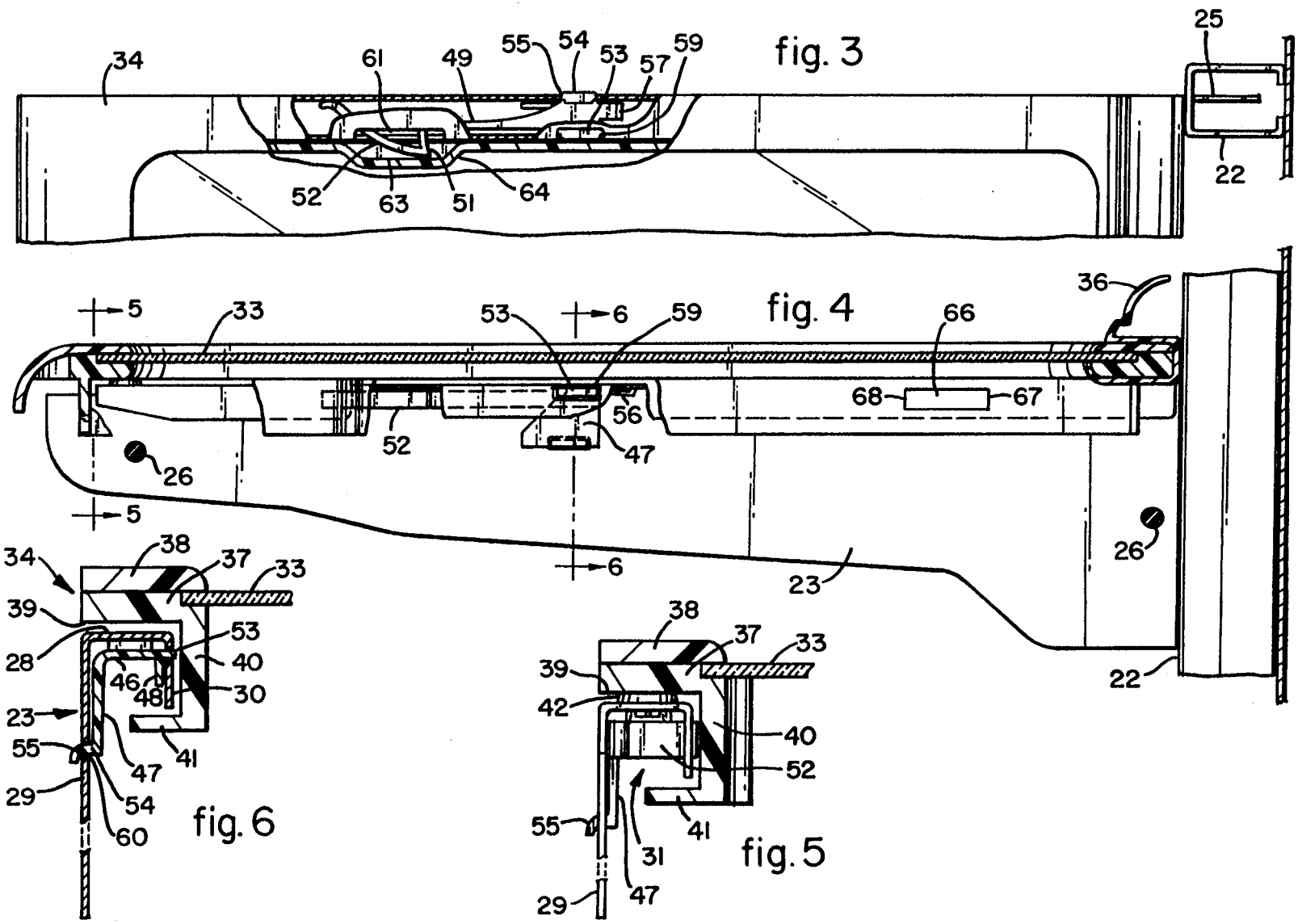
FIG. 3 is a fragmentary plan view of an edge portion of the shelf assembly of FIG. 2, in its retracted position, the view being partially cut away and partly in section for purposes of illustration.
FIG. 4 is a side elevational view of the shelf assembly of FIG. 3, with the right hand support removed and with the view partially in section for purposes of illustration.
FIG. 5 is a cross-sectional view as taken along line 5—5 in FIG. 4.
FIG. 6 is a cross-sectional view as taken along line 6—6 in FIG. 4.

Referring particularly to FIGS. 5–6, it will be seen that the rim conveniently is of a two part construction including a lower member 37, in which the plate 33 is seated, and an upper member 38 which fits over and extends above the upper surface of the plate 33. The lower member 37 is formed with an elongated horizontally disposed runner 39, which extends over the top wall 28 of support 23, a depending flange 40 which extends downwardly from the runner 39 adjacent the inside of inner side wall 30 of support 23, and a lip 41, which projects outwardly of the lower edge of flange 40 under the lower edge of inner wall 30.

When the shelf structure 27 is mounted on the supports the runner 39 slides over the top wall 28 as the shelf structure is moved between its retracted and extended positions. If desired, the support 23 and rim 34 may be constructed from materials which permit direct sliding contact between them. However, it is presently preferred to attach low friction pads, such as that shown at 42, to the top of top wall 28. This provides a low cost low friction sliding engagement between the runner and top wall.

It is highly desirable to provide a mechanism which controls the movement of the shelf. For example, the outward movement of the shelf should be affirmatively limited at the extended position to assure that an user does not accidentally pull the shelf too far out, which could cause food or other items to spill or fall off of the shelf. Also, it is desirable that the shelf be releasably retained in both its retracted and its extended positions so that it does not move inadvertently while permitting easy movement by an user.

Figure 10:
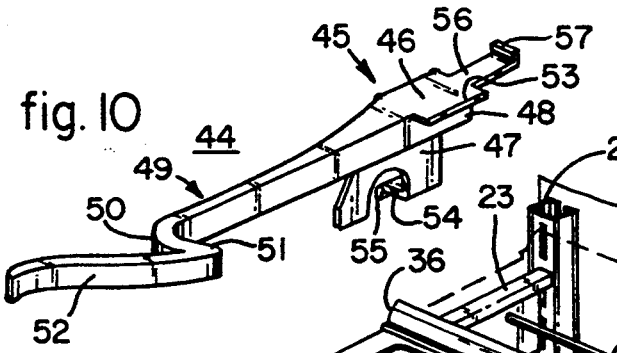
FIG. 10 is a perspective view of the latch member incorporated into the shelf assembly of FIGS. 1–9.

Referring now to FIG. 10, there is illustrated an unitary latch member 44 which interacts with the support 23 and the shelf rim 34 to provide the desired operation of the shelf structure 27. The latch includes a main body 45 having a top wall 46 and spaced apart side walls 47 and 48. A resilient finger 49 is an extension of top wall 46 and side wall 48 and extends longitudinally from the body 45. The finger 49 is offset at 50 to form a tang or nose 51 which projects generally perpendicularly to the right (as seen in FIG. 10). In the illustrative embodiment the nose 51 is slightly reentrant so that it extends slightly backward toward the main body 45. The distal end 52 of the finger is smoothly curved back toward the longitudinal axis of the finger. Thus the portion of the finger consisting of nose 51 and distal end 52 has an at rest position or configuration which is off set form the axis of the finger. However, the latch is made from a material, such as polyacetal for example, which enables the finger to flex in operation, as will be described in more detail hereafter. Returning to the main body 45, it will be seen that a tab 53 projects outwardly from side wall 48 adjacent its junction with top wall 46 and a tab 54 projects outwardly of the lower edge of side wall 47 and includes a downwardly projecting rib 55 at its distal end. The tabs 53 and 54 are sturdy and not readily flexible. A resilient tab 56 projects outwardly from the end of top wall 46 opposite finger 49, is inclined upwardly and terminates in an upwardly extending rib 57.

Referring now particularly to FIGS. 3–6, it will be seen that the latch is mounted in the inverted-U shaped cavity 31 of support 23 with main body top wall 46 and side wall 47, 48 in register with the support top wall 28, outer side wall 29 and inner side wall 30 respectively. The body is retained in this position by tab 53 being received in a slot 59 at the junction of top wall 28 and inner side wall 30 of support 23 and by tab 54 being received in a slot 60 in outer side wall 29 of support 23 with rib 55 overlapping wall 29 just below slot 60. Additionally the laterally projecting portion of the finger, comprised of the nose 51 and distal end 52, is received through a slot or opening 61 in the inner side wall 30. When the latch 45 is so mounted within the support, the rib 57 at the end of tab 56 is forced against the underside of support top wall 28 and the tab is flexed. This exerts a force about the pivots formed by the tabs 53 and 54 in their respective slots urging finger 49 upwardly so that it stays in alignment with slot 61.

Referring now particularly to FIGS. 2 and 3, it will be seen that the depending flange 40 of shelf rim 34 is formed with a recess 63 which projects inwardly away from the inner side wall 30 of support 23. The offset portion of finger 49 is received in the recess 63 when the shelf is in its retracted position (see FIG. 3). The end wall 64 of the recess is angled so that, as the shelf is moved from its retracted position to its extended position, the wall 64 will easily cam the finger back into the cavity of the support so as not to interfere with shelf movement. It will be understood that the projecting finger portion is received is the recess 63 whenever the refrigerator door 16 is closed, which is the vast majority of the time. Thus this arrangement both provides a releasable retracted positioning of the shelf and accommodates the finger 49 in its at rest or unstressed state most of the time. This enhances the long life of the latch.

Shelf rim depending flange 40 has another slot 66, with a rear end wall 67 and a forward end wall 68 (see FIG. 4). When the shelf structure is in its extended position the nose 51 of the finger projects through the slot 66. This releasably retains the shelf in its designed extended position. Referring particularly to FIG. 7, it will be seen that the nose extends transversely of the slot end wall 67. This prevents the shelf from being pulled any further out of the fresh food compartment than the illustrated extended position. On the other hand, the smoothly curved shape of finger distal end 52 enables the front end wall 68 of the slot to cam the finger back into the support cavity when the shelf is pushed inward from its extended position toward its retracted position.

With this assembly the shelf is releasably held in both its retracted position and its extended position. Movement of the shelf outward beyond its extended position is prevented. At the same time the effort to move the shelf between its retracted and extended positions is limited so as to inhibit sudden of jerky movements likely to spill items stored on the shelf.

Only the left support and corresponding shelf rim of the illustrative embodiment have been described in detail as one latch arrangement is sufficient for most shelves. In that event the support and rim on the other side of the shelf assembly would not have a latch mechanism. It will be understood that such a single latch mechanism can equally well be provided on either side of a shelf. It also will be understood that, if desired, a latch mechanism can be provided on each side of the shelf. In that event the mechanism on the right side conveniently would be a mirror image of that illustrated and described.

What is claimed is:

1. A slide-out shelf assembly for a refrigerator compartment compartment, including:

a pair of supports mounted in said refrigerator compartment in spaced apart relationship;

at least one of said supports having a generally horizontal top wall and a pair of spaced apart, depending side walls;

a shelf structure including a lateral edge portion mounted for sliding movement on said support top wall between a retracted position fully contained within said refrigerator compartment and an extended position projecting at least partially out of said refrigerator compartment, said shelf structure also including depending flanges positioned adjacent corresponding ones of said side walls;

a latch member mounted between said side walls of said at least one of said supports, said latch member including a resilient finger having a rest position in which a first portion of said finger extends through a corresponding opening in a predetermined one of said side walls of said one support; and the corresponding one of said shelf structure flanges adjacent said predetermined one of said side walls being constructed and arranged to interfit with said finger to releasably secure said shelf in its extended position.

2. A shelf assembly as set forth in claim 1, wherein:

said corresponding shelf flange is also constructed and arranged to interfit with said finger to releasably secure said shelf structure in its retracted position.

3. A shelf assembly as set forth in claim 1, wherein:

a slot in said corresponding shelf flange is positioned to receive said first portion of said finger when said shelf assembly is in its extended position, said slot including a rear edge;

said first portion of said finger is formed with a first section facing the rear of the refrigerator compartment and extending transverse to said rear edge of said slot to prevent movement of said shelf assembly forward of its extended position, said first portion of said finger also including a second section facing the front of the refrigerator compartment and smoothly curved to limit the effort required to move said shelf assembly from its extended position toward its retracted position.

4. A shelf assembly as set forth in claim 2, wherein:

said corresponding shelf flange also includes a recess projecting away from said corresponding support side wall and positioned to releasably receive said first portion of said latch finger when said shelf assembly is in its retracted position.

5. A shelf assembly as set forth in claim 1, wherein:

said latch member also includes a body having a top wall and spaced apart depending side walls, said body being positioned within said one support with its top and side walls in register with said top and side walls respectively of said one support;

said resilient finger extending from said body with said first finger portion normally projecting through an opening formed in said predetermined side wall of said one support.

6. A shelf assembly as set forth in claim 5, wherein:

tabs project laterally outward of each side wall of said latch body and are received in mating slots in said one of said supports to position said latch within said one support.

7. A shelf assembly as set forth in claim 6, wherein:

one of said tabs includes a transverse rib at its distal end overlapping an edge of the mating slot.

8. A shelf assembly as set forth in claim 5, wherein:

said latch body further includes a resilient tab extending from said latch member body top wall opposite said finger and having a rest position projecting upwardly of said latch top wall, said resilient tab engaging said top wall of said one support when said latch is mounted in said support to urge said finger upwardly within said support.

9. A shelf assembly as set forth in claim 5, wherein:

a slot formed in said corresponding shelf flange is positioned to receive said first portion of said finger when said shelf assembly is in its extended position, said slot including a rear edge;

said first finger portion being formed with a first section facing the rear of the refrigerator compartment and extending transverse to said rear edge of said slot to prevent movement of said shelf assembly forward of its extended position, said first finger portion also including a smoothly curved second section facing the front of the refrigerator compartment to limit the effort required to move said shelf assembly from its extended position toward its retracted position.

10. A shelf assembly as set forth in claim 5, wherein:

said corresponding shelf flange also includes a recess projecting away from said predetermined corresponding support side wall and positioned to releasably receive said first portion of said latch finger when said shelf assembly is in its retracted position.

11. A slide-out shelf assembly for a refrigerator compartment, including:

a pair of supports mounted in said refrigerator compartment in spaced apart relationship;

each of said supports having a generally horizontal top wall and spaced apart inner and outer, depending side walls forming an inverted-U shaped cavity;

a shelf structure including a shelf plate having opposed lateral edges and a molded rim encapsulating the edge of said plate, said rim including spaced apart side portions having generally horizontal runners resting on said support top walls and depending flanges projecting downwardly adjacent said inner side walls of said supports to support said shelf structure for sliding movement on said supports between a retracted position fully contained within the refrigerator compartment and an extended position projecting at least partially out of the refrigerator compartment; and an unitary plastic latch member mounted within said inverted-U cavity of one of said supports and including a resilient finger having a rest configuration with a first portion of said finger projecting through an opening in said inner side wall of said one support;

the corresponding depending flange of said shelf rim including a slot which registers with said first finger portion when said shelf structure is in its extended position for releasably positioning said shelf structure.

12. A shelf assembly as set forth in claim 11, wherein: said slot in said corresponding depending flange of said shelf rim includes a rear edge; said first finger portion is formed with a first section facing the rear of said refrigerator compartment and extending generally transverse to said rear edge of said slot in said corresponding depending flange to prevent movement of said shelf assembly forward of its extended position, and said first finger portion also is formed with a smoothly curved second section facing the front of the refrigerator compartment to limit the effort required to move said assembly from its extended position toward its retracted position.

13. A shelf assembly as set forth in claim 11, wherein: said corresponding shelf flange also includes a recess projecting away from said inner side wall of said one support and positioned to releasably receive said first portion of said latch finger when said shelf assembly is in its retracted position.

14. A shelf assembly as set forth in claim 11, wherein: said latch member also includes a body having a top wall and spaced apart depending side walls, said body being positioned within said inverted-U cavity of said one support with its top and side walls in register with said top and side walls respectively of said one support, with said resilient finger extending from said body and with said first finger portion normally projecting through said opening in said corresponding inner side wall.

15. A shelf assembly as set forth in claim 14, wherein: tabs project laterally outward of each side wall of said latch body and are received in mating slots in said one support to affirmatively position said latch within said one support.

16. A shelf assembly as set forth in claim 15, wherein: one of said tabs includes a transverse rib at its distal end overlapping an edge of the mating slot.

17. A shelf assembly as set forth in claim 15, wherein: said body of said latch further includes a resilient tab projecting rearwardly of said latch member body top wall and having a rest position projecting upwardly of said latch top wall, said resilient tab engaging said top wall of said corresponding support when said latch is mounted in said support to urge said finger upwardly within said support.

* * * * *